US010831123B2

(12) United States Patent
Hirano

(10) Patent No.: US 10,831,123 B2
(45) Date of Patent: Nov. 10, 2020

(54) INFORMATION PROCESSING APPARATUS AND IMAGE FORMING APPARATUS

(71) Applicant: CANON KABUSHIKI KAISHA, Tokyo (JP)

(72) Inventor: Yasuhiko Hirano, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/561,810

(22) Filed: Sep. 5, 2019

(65) Prior Publication Data

US 2020/0081367 A1 Mar. 12, 2020

(30) Foreign Application Priority Data

Sep. 10, 2018 (JP) ..... 2018-169160

(51) Int. Cl.
*G03G 15/04* (2006.01)
*G03G 15/043* (2006.01)

(52) U.S. Cl.
CPC ..... *G03G 15/043* (2013.01)

(58) Field of Classification Search
CPC ..... G03G 15/04; G03G 15/043; G03G 15/04036; G03G 15/04045; G03G 15/04054; G03G 15/04072; H04N 1/113; H04N 1/1135; B41J 2/47; B41J 2/435; B41J 2/471; G02B 26/10; G02B 26/12; G02B 26/122; G02B 26/127
See application file for complete search history.

(56) References Cited

U.S. PATENT DOCUMENTS 9,575,314 B2 2/2017 Araki ..... G02B 26/124
2018/0152586 A1 5/2018 Hirano ..... H04N 1/1135

FOREIGN PATENT DOCUMENTS

JP 2011148142 A * 8/2011
JP 2014-038165 2/2014

OTHER PUBLICATIONS

JP 2011148142 English machine translation, Hirano, Aug. 4, 2011 (Year: 2011).*

* cited by examiner

*Primary Examiner* — Thomas S Giampaolo, II
(74) *Attorney, Agent, or Firm* — Venable LLP

(57) ABSTRACT

An image forming apparatus includes a laser scanner unit configured to scan a photosensitive drum through use of a laser beam deflected by a reflection face of a polygon mirror, an engine controller, and an image controller. The engine controller generates an image formation BD signal synchronized with a BD signal output from the laser scanner unit. The image controller stores in advance, into a ROM, difference information indicating a difference between pulse cycles of image formation BD signals corresponding to respective reflection faces, acquires a difference between pulse cycles of an image formation BD signal output at the time of image formation, and compares the acquired difference with the difference information stored in the ROM to identify a reflection face.

8 Claims, 8 Drawing Sheets

INFORMATION PROCESSING APPARATUS AND IMAGE FORMING APPARATUS

BACKGROUND OF THE INVENTION

Field of the Invention

The present disclosure relates to an information processing apparatus configured to correct image data to transmit the image data to an image forming apparatus, and to an image forming apparatus to which the information processing apparatus is connected.

Description of the Related Art

An electrophotographic image forming apparatus configured to use a laser or other such light sources, such as a laser printer and a digital copying machine, includes an optical scanning unit (laser scanner unit) for exposing a photosensitive member. The optical scanning unit includes a light source configured to emit a laser beam based on image data representing an image to be formed, a rotary polyhedron (polygon mirror) having a plurality of reflection faces, and a scanning lens. The laser beam emitted from the light source is reflected and deflected by one of the reflection faces of the rotary polyhedron and is transmitted through the scanning lens to expose the photosensitive member, to thereby form an electrostatic latent image on the photosensitive member. In this process, rotation scanning, in which the rotary polyhedron is rotated to move a spot (exposed position) on the photosensitive member at which the laser beam is emitted, is performed.

A shape of a reflection face of the rotary polyhedron for deflecting the laser beam differs from one face to another. When the shape of the reflection face differs from one face to another, an electrostatic latent image formed on an outer peripheral surface of a photosensitive drum by the laser beams deflected by the respective reflection faces is disadvantageously deformed.

One of the causes of deformation of an electrostatic latent image is a difference in characteristic between the reflection faces of the rotary polyhedron. Thus, there has been proposed a technology involving identifying each reflection face of the rotary polyhedron and correcting distortion based on a result of the identification. In Japanese Patent Application Laid-open No. 2014-38165, there is disclosed an image forming apparatus in which a phase of a fundamental wave component, which is extracted from cycle data on as many detection signals (synchronization signals) as the number of reflection faces of a rotary polyhedron, is compared with phase information associated in advance, to thereby identify a reflection face. In U.S. Pat. No. 9,575,314 B2, there is disclosed an image forming apparatus in which a reflection face is identified based on synchronization signals generated for respective reflection faces of a rotary polyhedron and a magnification of an image is corrected for each reflection face based on a result of the identification.

A main-scanning synchronization signal to be used to identify a reflection face is output from a sensor configured to receive a laser beam deflected by the reflection face, before the photosensitive member is scanned. The sensor successively receives laser beams deflected by the respective reflection faces through the rotation of the rotary polygon mirror, and outputs the main-scanning synchronization signal in response to the reception of the laser beam. The main-scanning synchronization signal is a signal corresponding to a cycle of scanning of the laser beam onto the photosensitive member. A timing to output the main-scanning synchronization signal varies depending on, for example, fluctuation of rotation of the rotary polyhedron or an error in measurement. Accordingly, in the related art, before image formation is started, a time interval between adjacent pulses of the main-scanning synchronization signal is measured a plurality of times (e.g., 32 times), and an average value of the measured time intervals is used as an actual value of the time interval between adjacent pulses of the main-scanning synchronization signal. This minimizes the influence of the fluctuation of rotation or an error in measurement on the main-scanning synchronization signal. The scanning cycle of the main-scanning synchronization signal (average value) measured in this manner is compared with a cycle measured in advance for each reflection face of the rotary polyhedron. Each reflection face is identified based on a result of comparison of the cycles. Distortion correction is performed based on a correction value corresponding to the identified reflection face, to thereby suppress distortion of an image due to the reflection face. However, in the related-art method, it takes time to measure the time interval between adjacent pulses of the main-scanning synchronization signal a plurality of times before image formation is started, and hence an image forming operation is delayed, resulting in a disadvantageous decrease in printing speed. It is a main object of the present disclosure to suppress reduction in productivity in image formation.

SUMMARY OF THE INVENTION

An information processing apparatus, which is connected to an image forming apparatus including an image forming unit, according to the present disclosure includes: a photosensitive member; a receiver configured to receive image data; a light source configured to output light based on the image data received by the receiver; a rotary polygon mirror, which has a plurality of reflection faces, and is configured to rotate to deflect the light output from the light source by the plurality of reflection faces, to thereby scan the photosensitive member; a light receiver configured to receive the light deflected by the rotary polygon mirror; and a first output unit configured to output, based on a result of receiving the light by the light receiver, a pulse signal containing a pulse train including a signal of a first level and a signal of a second level, the information processing apparatus comprising: a storage configured to store first information indicating a relationship between 1) a length of a scanning cycle corresponding to a first face among the plurality of reflection faces and 2) a length of a scanning cycle corresponding to a second face different from the first face, the first face being a reflection face adjacent to the second face in a rotation direction in which the rotary polygon mirror rotates; an identifier configured to identify, based on a relationship between a first time interval between a first pulse included in the pulse train and a second pulse subsequent to the first pulse and a second time interval between the second pulse and a third pulse subsequent to the second pulse, and on the first information stored in the storage, a reflection face to be used for scanning of the photosensitive member from among the plurality of reflection faces; a corrector configured to correct the image data such that the correction corresponds to the reflection face identified by the identifier; and a second output unit configured to output the image data corrected by the corrector to the image forming unit in response to a pulse being output from the first output unit.

Further features of the present invention will become apparent from the following description of exemplary embodiments (with reference to the attached drawings).

DESCRIPTION OF THE EMBODIMENTS

In the following, at least one preferred embodiment of the present disclosure is described with reference to the drawings.

Overall Structure

Figure 1:
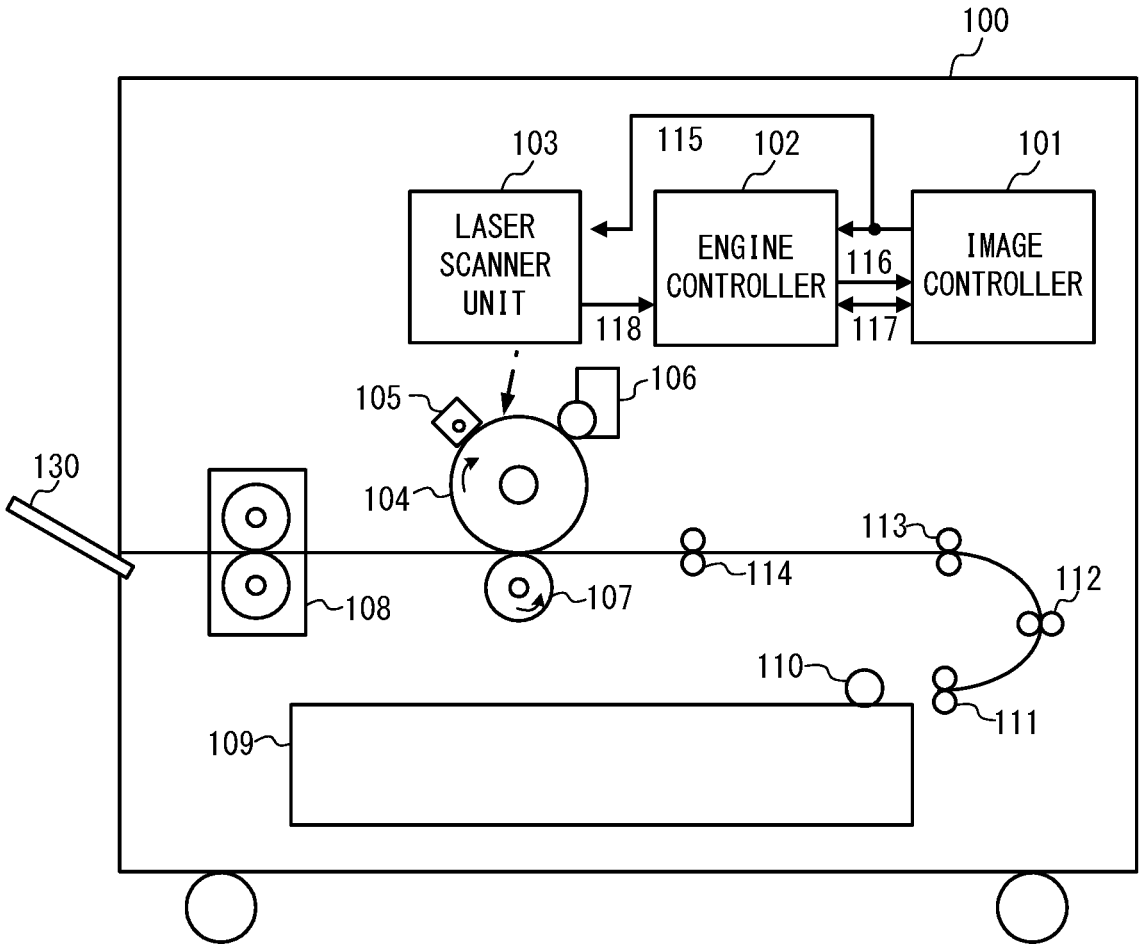
FIG. 1 is a diagram for illustrating a configuration of an image forming apparatus according to at least one embodiment of the present disclosure.

FIG. 1 is a cross-sectional view for illustrating a configuration of a monochrome electrophotographic copying machine (hereinafter referred to as "image forming apparatus") 100. The image forming apparatus 100 is not limited to a copying machine, and may also be, for example, a facsimile machine, a printing machine, or a printer. Further, the type of image forming apparatus 100 may be any of a monochrome type and a color type. In the following, the configuration and functions of the image forming apparatus 100 are described.

The image forming apparatus 100 includes an image controller 101, an engine controller 102, an image forming mechanism, a conveyance mechanism configured to convey a recording material, a transfer roller 107, and a fixing device 108. The image forming mechanism includes a laser scanner unit 103, a photosensitive drum 104, a charging device 105, a developing device 106, and other components. The image controller 101 converts print data acquired from a host computer (not shown) into image data 115 printable by the image forming apparatus 100, and transmits the image data 115 to the laser scanner unit 103 and the engine controller 102. The image controller 101 is connected to the engine controller 102 via a communication line 117. The image controller 101 performs, for example, serial communication to/from the engine controller 102 through use of the communication line 117. For example, the image controller 101 transmits a command signal for controlling the image forming mechanism to the engine controller 102 via the communication line 117, and receives a status signal for acquiring a status of each component of the image forming apparatus 100 from the engine controller 102 via the communication line 117.

The image forming apparatus 100 includes a cassette sheet feeder 109, in which a recording material is accommodated. The recording material accommodated in the cassette sheet feeder 109 is fed by the conveyance mechanism to a conveyance path included in the image forming apparatus 100. The conveyance mechanism includes a pickup roller 110, a separation roller pair 111, conveyance roller pairs 112 and 113, and a registration roller pair 114. The pickup roller 110 feeds recording materials accommodated in the cassette sheet feeder 109 to the conveyance path. The fed recording materials are separated one by one by the separation roller pair 111 including a feed roller serving as a conveyance unit and a retard roller serving as a separation unit. The separated recording material is conveyed to the registration roller pair 114, the rotation of which is stopped, by the plurality of conveyance roller pairs 112 and 113. The recording material is a material on which an image is to be formed by the image forming apparatus 100, and examples of the recording material include a sheet of paper, a resin sheet, a piece of cloth, an OHP sheet, and a label.

A leading edge of the recording material conveyed to the registration roller pair 114 abuts against a nip of the registration roller pair 114. The registration roller pair 114 is stopped and the conveyance roller pair 113 is rotating, and hence the recording material bends to form a loop. Skew feeding of the recording material is corrected through the formation of the loop.

The photosensitive drum 104 serving as a photosensitive member rotates in a clockwise direction in FIG. 1 when an image is formed, and has a face uniformly charged by the charging device 105. The laser scanner unit 103 serving as an optical scanning unit exposes the charged photosensitive drum 104 with a laser beam modulated based on the image data 115, to thereby form an electrostatic latent image on the photosensitive drum 104. The electrostatic latent image is visualized by toner supplied from the developing device 106. In this manner, a toner image is formed on the photosensitive drum 104.

In synchronization with time when the toner image is formed on the photosensitive drum 104, the recording material is conveyed to the transfer roller 107 by the registration roller pair 114. The transfer roller 107 forms a transfer portion between the transfer roller 107 and the photosensitive drum 104. The recording material has the toner image transferred thereto from the photosensitive drum 104 at the transfer portion. The recording material to which the toner image is transferred is conveyed to the fixing device 108. The fixing device 108 heats and pressurizes the recording material, to thereby fix the toner image to the recording material. The recording material to which the toner image is fixed is delivered to a delivery tray 130 provided outside the image forming apparatus 100. Although not shown, a cleaner for cleaning toner remaining after the transfer of the toner image is arranged around the photosensitive drum 104.

In the above-mentioned manner, the image is formed on the recording material. All of the operations are implemented by exchanging a command signal and a status signal between the image controller 101 and the engine controller 102 via the communication line 117.

Laser Scanner Unit

Figure 2:
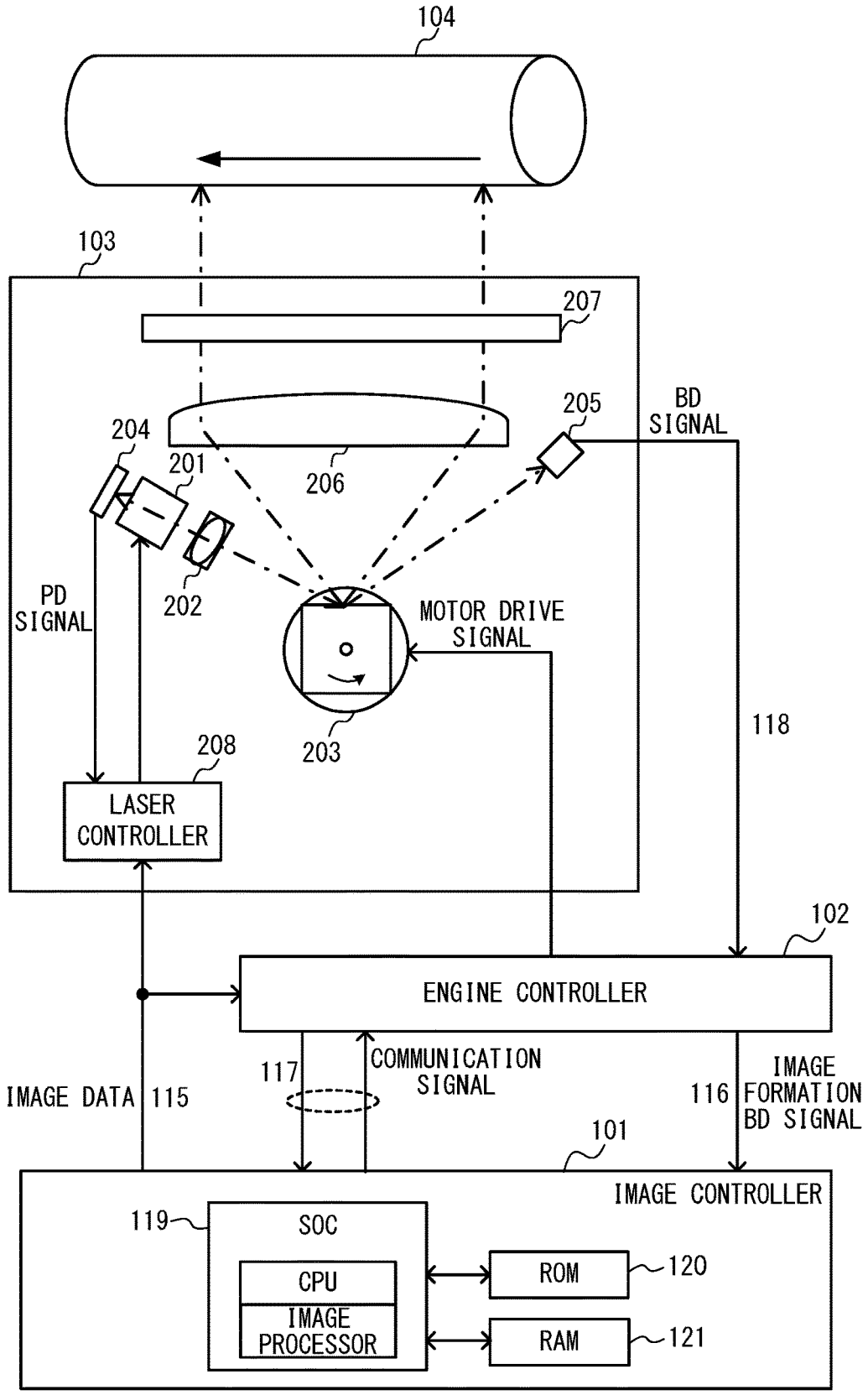
FIG. 2 is an explanatory diagram of a laser scanner unit.

FIG. 2 is an explanatory diagram of the laser scanner unit 103. The laser scanner unit 103 has an operation controlled by the engine controller 102 and the image controller 101. The image controller 101 corresponds to an information processing apparatus according to at least one embodiment of the present disclosure. In at least one embodiment, the image controller 101 and the engine controller 102 are mounted on different boards.

The laser scanner unit 103 includes a laser light source 201, a collimator lens 202, a polygon mirror 203, a photodiode 204, a beam detect sensor 205, an F-θ lens 206, and a reflection mirror 207. The beam detect sensor 205 is hereinafter referred to as "BD sensor" 205. The laser scanner unit 103 includes a laser controller 208 configured to control light emission of the laser light source 201 in accordance with the image data 115 input from the image controller 101.

The laser light source 201 emits laser beams in two directions with a light emitting element. The laser beam emitted from the laser light source 201 in one of the directions enters the photodiode 204. The photodiode 204 converts the incident laser beam into an electrical signal in accordance with an amount of light, and transmits the electrical signal to the laser controller 208 as a PD signal. The laser controller 208 controls, based on the PD signal, the amount of light to be output from the laser light source 201 (performs auto power control (APC)) such that a light amount of the laser beam becomes a predetermined light amount. In this case, general APC is performed, and hence a detailed description thereof is omitted.

The laser beam emitted from the laser light source 201 in the other one direction is applied onto the polygon mirror 203 via the collimator lens 202. The polygon mirror 203 serves as a rotary polygon mirror, which has a plurality of reflection faces, and is configured to be rotationally driven by a polygon motor (not shown) based on a motor drive signal output from the engine controller 102. The polygon mirror 203 in this embodiment has four reflection faces. The polygon motor rotationally drives the polygon mirror 203 in accordance with a motor drive signal output from the engine controller 102.

The laser beam applied to the polygon mirror 203 is deflected toward a direction of the photosensitive drum 104 by one of the reflection faces. When the polygon mirror 203 is rotated, a deflection angle of the laser beam changes. Through a change in deflection angle, the laser beam scans the photosensitive drum 104 in one direction. In this embodiment, the laser beam scans the photosensitive drum 104 from the right side to left side of FIG. 2. The laser beam has its optical path corrected by the F-θ lens 206 so as to scan the photosensitive drum 104 at constant speed, and is applied onto the photosensitive drum 104 via the reflection mirror 207. Through scanning by one reflection face, an electrostatic latent image corresponding to one line is formed in a main scanning direction. The plurality of reflection faces successively scan the photosensitive drum 104 through rotation of the polygon mirror 203, and the photosensitive drum 104 rotates in a sub-scanning direction orthogonal to the main scanning direction, to thereby successively form an electrostatic latent image corresponding to one line on the photosensitive drum 104. As a result, the electrostatic latent image corresponding to one page is formed on the photosensitive drum 104.

The laser beam, which is deflected by the polygon mirror 203, is received by the BD sensor 205 before the laser beam is applied onto the photosensitive drum 104. The BD sensor 205 in this embodiment is a detector arranged at such a position as to be able to detect a laser beam before the laser beam starts scanning of the photosensitive drum 104. Specifically, for example, as illustrated in FIG. 2, the BD sensor 205 is arranged in a region that is a part of a region through which the laser beam reflected by the polygon mirror 203 passes, and that is outside a region in which the photosensitive drum 104 is irradiated and is located on an upstream side in the scanning direction of the laser beam (in the main scanning direction). With this configuration, the laser beam emitted to the polygon mirror 203 is reflected by one of the reflection faces, and a part of the laser beam is received by the BD sensor 205.

The BD sensor 205 outputs a beam detection (BD) signal 118, which is a pulse signal set to a first level while the laser beam is being received and set to a second level while the laser beam is not being received. The BD signal 118 is a detection signal to be output in synchronization with scanning of the laser beam onto the photosensitive drum 104. In the description of at least one embodiment, the first level is a low level, and the second level is a high level, but the logic of the signal may be reversed.

The BD signal 118 is transmitted from the BD sensor 205 to the engine controller 102. The engine controller 102 controls the polygon motor based on the obtained BD signal 118 such that a rotation cycle of the polygon mirror 203 reaches a predetermined cycle. When the cycle of the BD signal 118 has reached the predetermined cycle, the engine controller 102 determines that the rotation cycle of the polygon mirror 203 is stable at the predetermined cycle. That is, the engine controller 102 adjusts the motor drive signal based on the BD signal 118, to thereby perform feedback control such that the rotation of the polygon mirror 203 is stable at the predetermined cycle.

The engine controller 102 transmits to the image controller 101 an image formation BD signal 116 serving as a synchronization signal for the BD signal 118. The BD signal 118 and the image formation BD signal 116 each indicate one scanning cycle at which the laser beam scans the photosensitive drum 104. When the rotation of the polygon mirror 203 has become stable, the engine controller 102 uses the registration roller pair 114 to resume the stopped conveyance of a recording material.

When the conveyance of the recording material is resumed, the engine controller 102 outputs the BD signal 118 to the image controller 101 as it is, as the image formation BD signal 116. When images of a plurality of pages are to be formed, the engine controller 102 temporarily stops output of the image formation BD signal 116 when formation of an image corresponding to one page is finished, and outputs again the image formation BD signal 116 when conveyance of the next recording material is resumed.

The image controller 101 includes a system-on-chip (SOC) 119 having a central processing unit (CPU) and an image processor built therein. The image controller 101 includes a read only memory (ROM) 120 configured to store a control program and a random access memory (RAM) 121 to be used as a work memory. The CPU executes the control program stored in the ROM 120, to thereby control the operation of the image forming apparatus 100. The CPU performs overall control of the operations of the image controller 101, the engine controller 102, and the laser controller 208.

When the image controller 101 has acquired a predetermined number of image formation BD signals 116, the image controller 101 starts output of the image data 115 to the laser controller 208 in synchronization with the image formation BD signal 116. At this time, the image controller 101 identifies a reflection face reflecting the laser beam, and corrects image data based on a correction value corresponding to the identified reflection face to output the corrected image data. The laser controller 208 drives the laser light source 201 based on the image data 115 to cause the laser light source 201 to be turned on and off, and forms on the photosensitive drum 104 a laser beam for forming an image (electrostatic latent image) corresponding to the image data. The laser beam driven to be turned on and off passes through the F-θ lens 206 to be corrected such that scanning at a constant angular velocity by the polygon mirror 203 is converted into scanning at a constant speed on the photosensitive drum 104, and then forms the electrostatic latent image on the photosensitive drum 104 via the reflection mirror 207.

Figure 3:
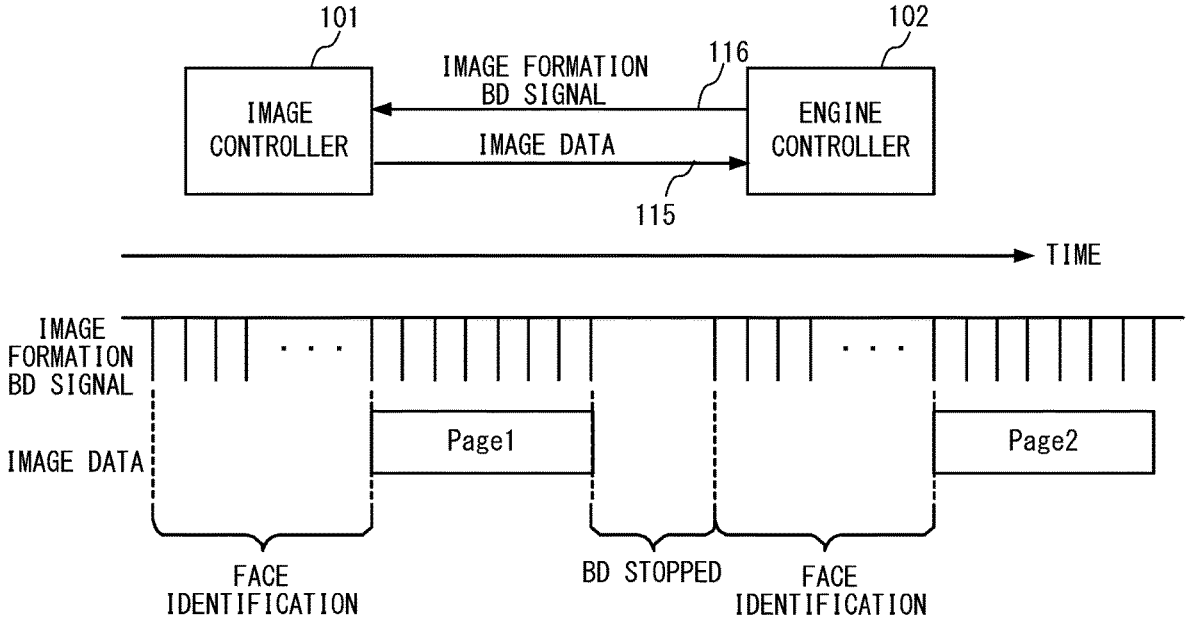
FIG. 3 is a timing chart of processing of identifying each reflection face.

FIG. 3 is a timing chart of processing of identifying each reflection face of the polygon mirror 203. As described above, when the polygon mirror 203 is rotationally driven by the engine controller 102 and the rotation of the polygon mirror 203 becomes stable, the image formation BD signal 116 is input from the engine controller 102 to the image controller 101. The image controller 101 performs processing of identifying each reflection face of the polygon mirror 203 based on the image formation BD signal 116.

When the BD sensor 205 receives a laser beam that has been reflected by each reflection face of the polygon mirror 203, the BD sensor 205 outputs the BD signal 118. The image formation BD signal 116 is synchronized with the BD signal 118. Thus, the image formation BD signal 116 has different pulse cycles due to the difference in shape between the reflection faces. The image controller 101 measures a pulse cycle of the image formation BD signal 116. In the related art, in consideration of fluctuation of rotation of the polygon mirror 203 and an error in measurement, for each of the four reflection faces, for example, the image controller 101 measures the cycle of the image formation BD signal 116 32 times (that is, the number of times corresponding to 32 revolutions of the polygon mirror 203), and obtains an average cycle of the measured cycles.

The image controller 101 repeatedly measures the cycle of the image formation BD signal until a required number of times of measurement of cycles is finished, and identifies a reflection face based on an average cycle of the cycles. When the image controller 101 has identified the reflection face, the image controller 101 corrects the image data 115 based on a correction value, such as a magnification of an image or a writing start position, in a manner that suits characteristics of each reflection face measured in advance. The image controller 101 outputs the corrected image data 115 to the laser controller 208. The measurement of the pulse cycle of the image formation BD signal and the processing of identifying a reflection face are performed in a period of "FACE IDENTIFICATION". When the engine controller 102 has output as many image formation BD signals as the number corresponding to one page, the engine controller 102 stops output of the image formation BD signal 116, and outputs again the image formation BD signal 116 when the conveyance of the next recording material is resumed. A period in which the output of the image formation BD signal 116 is stopped is a period of "BD STOPPED".

First Embodiment

Figure 4A:
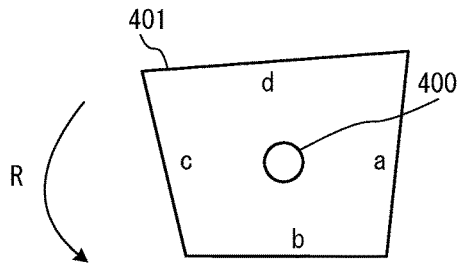
FIG. 4A and FIG. 4B are explanatory diagrams of a polygon mirror in a first embodiment of the present disclosure.
Figure 4B:
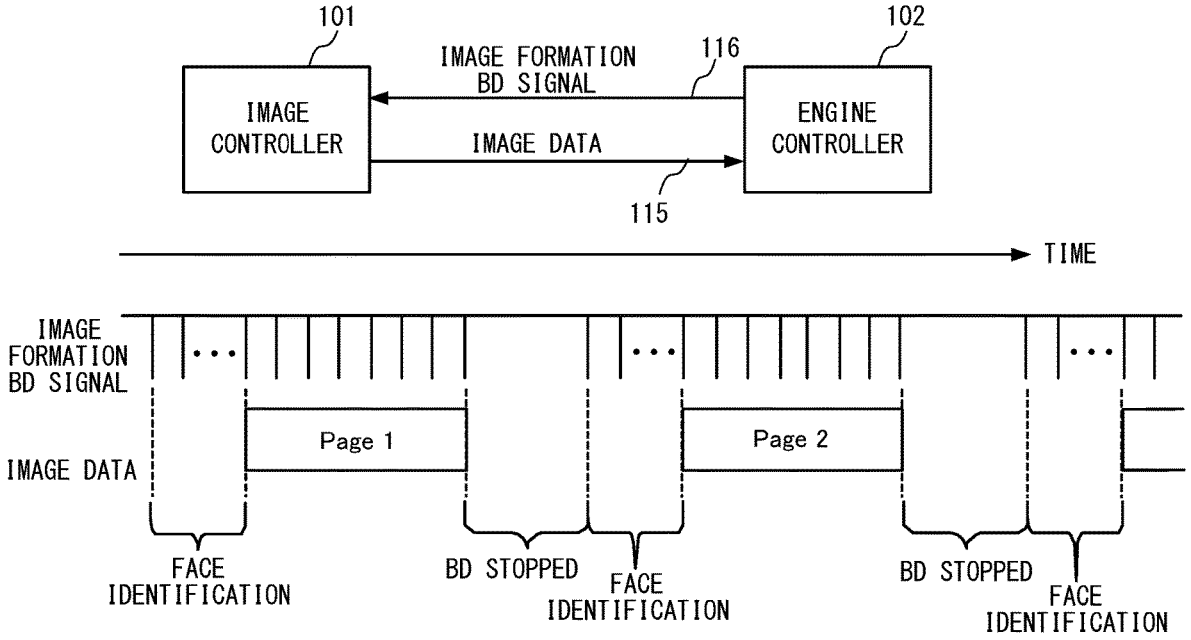

FIG. 4A and FIG. 4B are explanatory diagrams of a polygon mirror in a first embodiment of the present disclosure.

FIG. 4A is an illustration of the polygon mirror in the first embodiment. A polygon mirror 401 of FIG. 4A is configured to rotate in a rotation direction R about a rotation shaft 400. The polygon mirror 401 has four reflection faces a, b, c, and d. Of the four reflection faces a, b, c, and d, at least lengths of two reflection faces adjacent in the rotation direction R (lengths in the rotation direction R) differ from each other. Accordingly, the length of a face on which the laser beam is reflected at the time of scanning differs for each reflection face.

The difference in length between the reflection faces appears as a difference in pulse cycle (hereinafter simply referred to as "cycle") of the BD signal 118 output from the BD sensor 205. Each of the reflection faces a, b, c, and d of the polygon mirror 401 is formed such that the difference in cycle of the BD signal 118 due to the difference in length between the reflection faces is larger than the difference in cycle of the BD signal 118 caused by fluctuation of rotation of the polygon mirror 401 or an error in measurement of the laser beam by the BD sensor 205.

When the lengths of the respective reflection faces are made different from one another, as described below, a period of time for measuring the cycle of the BD signal 118 (image formation BD signal 116) required for identifying a reflection face can be shortened. FIG. 4B is a timing chart of the image formation BD signal and image data. The image controller 101 identifies a reflection face based on the cycle of the image formation BD signal 116 measured in the period of "FACE IDENTIFICATION", and corrects image data based on a correction value corresponding to the identified reflection face to output the corrected image data. When the engine controller 102 has output as many image formation BD signals as the number corresponding to one page, the engine controller 102 stops output of the image formation BD signal 116, and outputs again the image formation BD signal 116 when the conveyance of the next recording material is resumed.

Figure 5A:
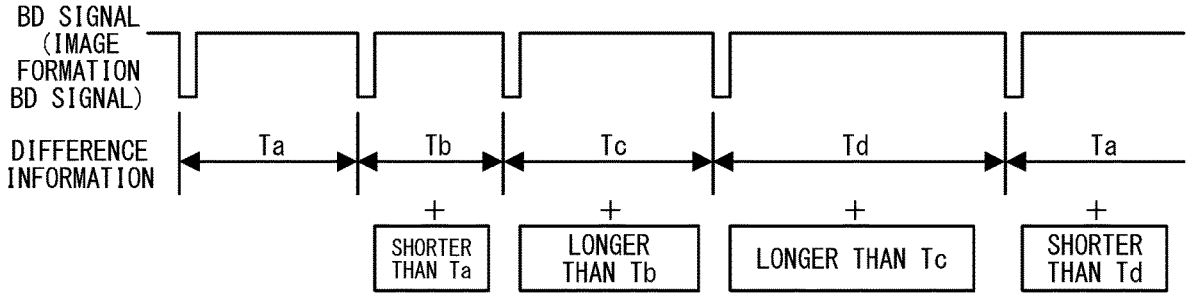
FIG. 5A, FIG. 5B, and FIG. 5C are explanatory diagrams of processing of identifying each reflection face.
Figure 5B:
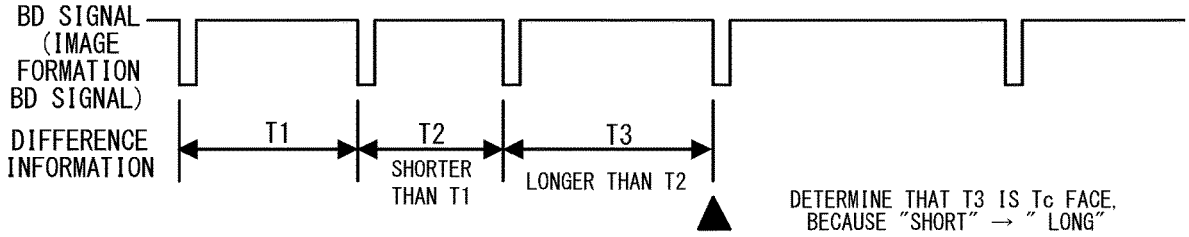
Figure 5C:
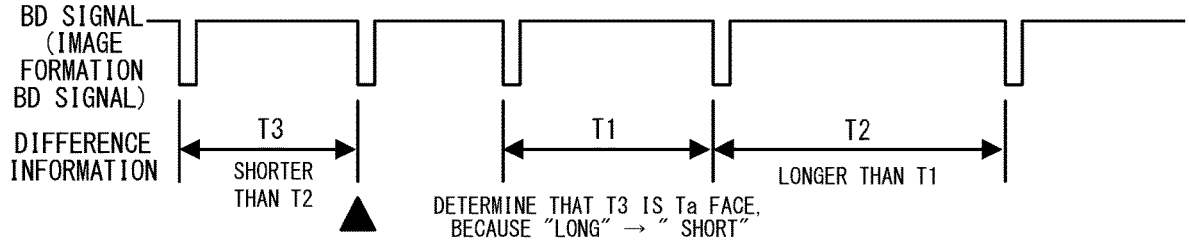

FIG. 5A, FIG. 5B, and FIG. 5C are explanatory diagrams of processing of identifying each reflection face of the polygon mirror 401.

FIG. 5A is an explanatory diagram of the cycle (BD cycle) of the BD signal 118 corresponding to each of the reflection faces a, b, c, and d of the polygon mirror 401. The image controller 101 uses the image formation BD signal 116 to measure a BD cycle Ta corresponding to the reflection face a of the polygon mirror 401, a BD cycle Tb corresponding to the reflection face b, a BD cycle Tc corresponding to the reflection face c, and a BD cycle Td corresponding to the reflection face d. In this case, the image controller 101 measures the BD cycle based on a time at which the falling edge of the image formation BD signal 116 is detected.

The image controller 101 compares the BD cycle of each reflection face with the BD cycles of the reflection faces before and after the reflection face to acquire difference information as a result of the comparison. The "difference information" refers to information on a difference between the BD cycles of adjacent reflection faces. For example, the difference information is length difference information, which indicates whether the BD cycle Tb of the adjacent reflection face b is longer or shorter than the BD cycle Ta of the reflection face a. In the case of FIG. 5A, there is acquired difference information indicating that the BD cycle Tb is shorter than the BD cycle Ta, the BD cycle Tc is longer than the BD cycle Tb, the BD cycle Td is longer than the BD cycle Tc, and the BD cycle Ta is shorter than the BD cycle Td. The difference information is acquired in advance at the time of manufacture of the image forming apparatus 100, for example.

The image controller 101 acquires, based on the difference information, a change pattern of the difference information between reflection faces adjacent in the rotation direction R of the polygon mirror 401. In the case of FIG. 5A, the change pattern of the difference information is "short"→"long"→"long"→"short". The difference information and the change pattern of the difference information are stored in advance in a predetermined memory, for example, a nonvolatile storage area of the RAM 121, a register of the SOC 119, or the ROM 120.

When an image is to be formed, the image controller 101 uses the image formation BD signal 116 to measure the BD cycle, and acquires difference information and a change pattern of the difference information based on a result of the measurement. The image controller 101 compares the acquired difference information and change pattern of the difference information with the difference information and the change pattern of the difference information that are stored in advance in the memory, to thereby identify a reflection face.

FIG. 5B is an illustration of an example of the BD signal 118 (image formation BD signal 116) at the time of image formation. In this case, the image controller 101 measures the BD cycles T1, T2, and T3. When the image controller 101 measures the BD cycle T2, the image controller 101 compares the BD cycle T2 with the BD cycle T1 to acquire the following difference information: "T2 is shorter than T1". When the image controller 101 measures the BD cycle T3, the image controller 101 compares the BD cycle T3 with the BD cycle T2 to acquire the following difference information: "T3 is longer than T2". The image controller 101 acquires a change pattern of the difference information that is "short"→"long". This change pattern of the difference information corresponds to a change pattern of the difference information exhibited when the BD cycle changes from the BD cycle Tb to the BD cycle Tc. Accordingly, the image controller 101 can determine that the BD cycle T3 is the BD cycle Tc. The image controller 101 identifies the reflection face c corresponding to the determined BD cycle Tc.

FIG. 5C is an illustration of an example of another BD signal 118 (image formation BD signal 116) at the time of image formation. In this case, when the image controller 101 measures the BD cycle T2, the image controller 101 compares the BD cycle T2 with the BD cycle T1 to acquire the following difference information: "T2 is longer than T1". When the image controller 101 measures the BD cycle T3, the image controller 101 compares the BD cycle T3 with the BD cycle T2 to acquire the following difference information: "T3 is shorter than T2". When the change pattern of the difference information "long"→"short" corresponds to a change pattern of the difference information exhibited when the BD cycle changes from the BD cycle Td to the BD cycle Ta. Accordingly, the image controller 101 can determine that the BD cycle T3 is the BD cycle Ta. The image controller 101 identifies the reflection face a corresponding to the determined BD cycle Ta.

When the image controller 101 has successfully identified one reflection face, the image controller 101 can sequentially identify the subsequent reflection faces based on the image formation BD signal 116. This is because the reflection face is switched in order due to the revolution of the polygon mirror 401, and the image controller 101 acquires the image formation BD signal 116 every time the reflection face is switched.

Figure 6:
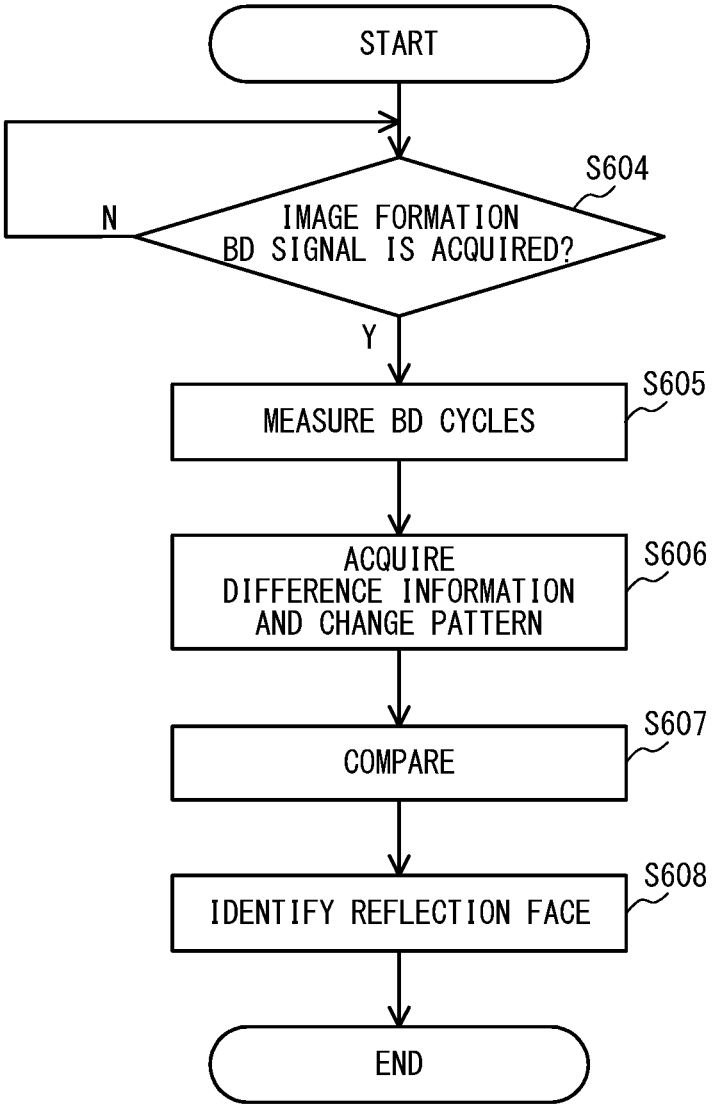
FIG. 6 is a flow chart for illustrating processing of identifying a reflection face.

FIG. 6 is a flow chart for illustrating processing of identifying a reflection face. In this case, an example of processing based on the BD signal 118 (image formation BD signal 116) illustrated in FIG. 5A, FIG. 5B, and FIG. 5C is described.

When image formation processing is started during the operation of the image forming apparatus 100, the image controller 101 acquires the image formation BD signal 116 from the engine controller 102 (Step S604: Y). The image controller 101 acquires three cycles of the image formation BD signals 116 to measure the BD cycles T1, T2, and T3 (Step S605). The image controller 101 acquires difference information and a change pattern of the difference information based on the measured three BD cycles T1, T2, and T3 (Step S606).

The image controller 101 compares the difference information and the change pattern of the difference information stored in advance in the memory with the difference information and the change pattern of the difference information acquired in the processing of Step S606 (Step S607). The image controller 101 identifies a reflection face based on a result of the comparison (Step S608).

Through such comparison of pieces of difference information on the BD cycles, a reflection face of the polygon mirror 401 can be quickly identified. Thus, a period of time required for identifying a reflection face is shortened. The period of time required for identifying a reflection face is shortened, to thereby shorten a period of time required for printing.

In the above description, information of "long" or "short" is used as the change pattern of the difference information, and the processing of identifying a reflection face is performed based on this information. Through such processing, for example, as compared with a case in which processing of identifying a reflection face is performed by accurately measuring BD cycles and numerically comparing the BD cycles, processing of identifying a reflection face is simplified, and hence the processing of identifying a reflection face can be quickly performed.

Second Embodiment

In the polygon mirror 401 in a second embodiment of the present disclosure, the lengths of reflection faces differ from one another as in FIG. 4A, but the relationship of the lengths of adjacent reflection faces differs from that of FIG. 4A. In this case, the length of each reflection face of the polygon mirror 401 is set such that the difference information (length difference information) on the BD cycles is a repetition of "long" and "short".

Figure 7A:
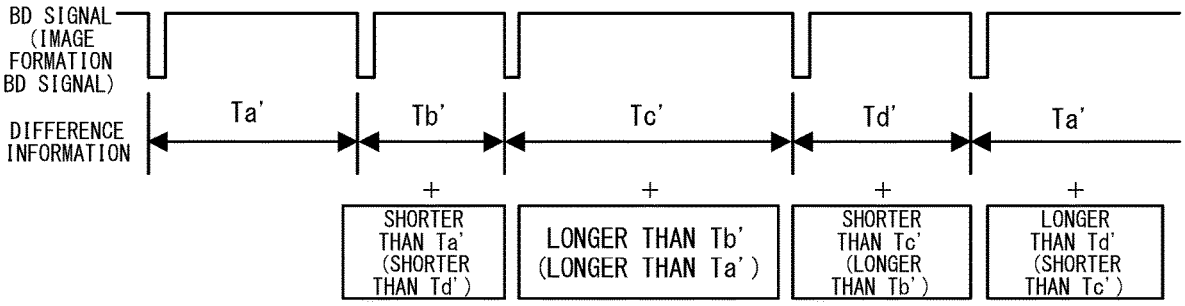
FIG. 7A, FIG. 7B, and FIG. 7C are explanatory diagrams of processing of identifying each reflection face.
Figure 7B:
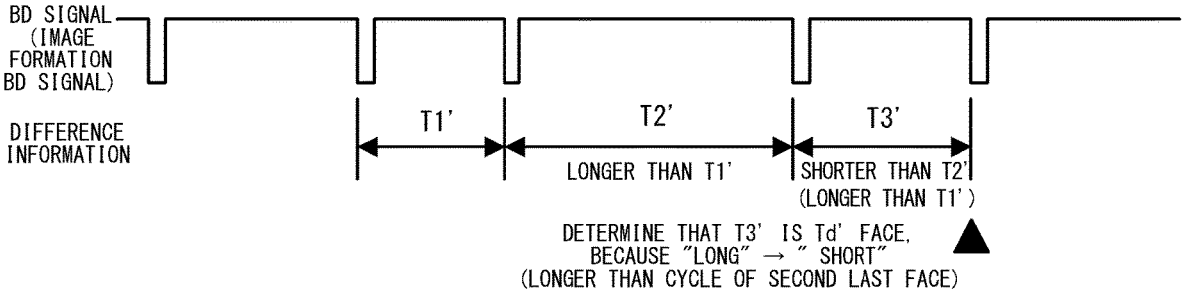
Figure 7C:
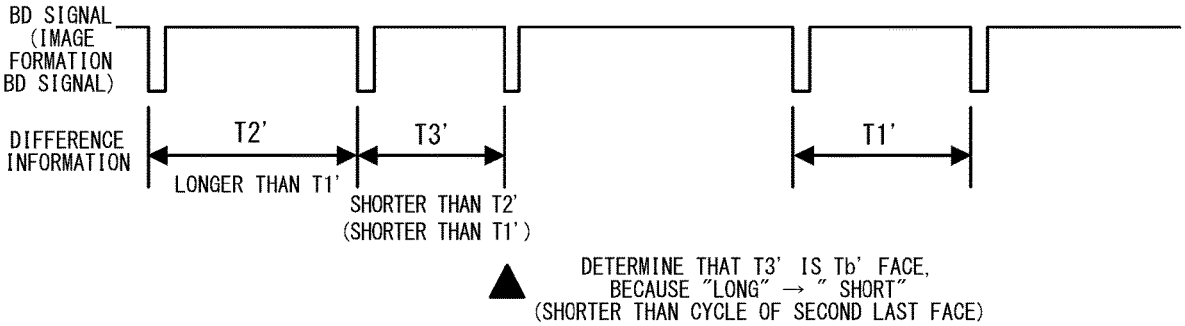

FIG. 7A, FIG. 7B, and FIG. 7C are explanatory diagrams of processing of identifying each reflection face of the polygon mirror 401.

FIG. 7A is an explanatory diagram of the cycle (BD cycle) of the BD signal 118 corresponding to each of the reflection faces a, b, c, and d of the polygon mirror 401. The image controller 101 uses the image formation BD signal 116 to measure a BD cycle Ta' corresponding to the reflection face a of the polygon mirror 401, a BD cycle Tb' corresponding to the reflection face b, a BD cycle Tc' corresponding to the reflection face c, and a BD cycle Td' corresponding to the reflection face d. In this case, the image controller 101 measures the BD cycle based on a time at which the falling edge of the image formation BD signal 116 is detected.

The image controller 101 compares the BD cycle of each reflection face with the BD cycles of the reflection faces before and after the reflection face to acquire difference information as a result of the comparison. In the case of FIG. 7A, there is acquired difference information indicating that the BD cycle Tb' is shorter than the BD cycle Ta', the BD cycle Tc' is longer than the BD cycle Tb', the BD cycle Td' is shorter than the BD cycle Tc', and the BD cycle Ta' is longer than the BD cycle Td'. In the second embodiment, difference information based on adjacent reflection faces is referred to as "first difference information".

The image controller 101 acquires, based on the first difference information, a change pattern of the difference information between reflection faces adjacent in the rotation direction R of the polygon mirror 401. In the case of FIG.

7A, the change pattern of the difference information is "short"→"long"→"short"→"long". That is, the change pattern of the difference information is a repeating pattern of "long" and "short", in which "long" and "short" alternately appear. In this case, it is difficult to identify a reflection face based on the change pattern of the difference information. For example, in the case of a piece of difference information "long", pieces of difference information on both sides of the first piece of difference information "long" and pieces of difference information on both sides of the second piece of difference information "long" are both "short", and hence those pieces of difference information "long" cannot be distinguished from each other.

Thus, in addition to the first difference information, the image controller 101 acquires difference information indicating a difference from the BD cycle of the second last reflection face in the rotation direction R. In the second embodiment, the difference information indicating the difference from the second last reflection face is referred to as "second difference information". In the case of FIG. 7A, there is acquired the second difference information indicating that the BD cycle Tb' is shorter than the BD cycle Td', the BD cycle Tc' is longer than the BD cycle Ta', the BD cycle Td' is longer than the BD cycle Tb', and the BD cycle Ta' is shorter than the BD cycle Tc'.

The first difference information and the second difference information can be obtained by measuring those pieces of information in advance at the time of manufacture of the image forming apparatus 100, for example. The change pattern of the first difference information and the change pattern of the second difference information can also be obtained in advance. In the case of FIG. 7A, the change pattern of the first difference information (first change pattern) is as follows: "short"→"long"→"short"→"long". The change pattern of the second difference information (second change pattern) is as follows: "short"→"long"→"long"→"short". The first difference information, the second difference information, the first change pattern, and the second change pattern are stored in advance in a predetermined memory, for example, a nonvolatile storage area of the RAM 121, a register of the SOC 119, or the ROM 120.

When an image is to be formed, the image controller 101 uses the image formation BD signal 116 to measure the BD cycle, and acquires difference information and a change pattern of the difference information based on a result of the measurement. The image controller 101 compares the acquired difference information and change pattern of the difference information with the first difference information and the first change pattern of the difference information that are stored in advance in the memory, or with the second difference information and the second change pattern of the difference information that are stored in advance in the memory, to thereby identify a reflection face.

FIG. 7B is an illustration of an example of the BD signal 118 (image formation BD signal 116) at the time of image formation. In this case, the image controller 101 measures the BD cycles T1', T2', and T3'. When the image controller 101 measures the BD cycle T2', the image controller 101 compares the BD cycle T2' with the last BD cycle T1' to acquire the following difference information: "T2' is longer than T1". When the image controller 101 measures the BD cycle T3', the image controller 101 compares the BD cycle T3' with the last BD cycle T2' to acquire the following difference information: "T3' is shorter than T2". Further, when the image controller 101 measures the BD cycle T3', the image controller 101 acquires the following difference information: "T3' is longer than T1" through comparison with the second last BD cycle T1'.

In the second embodiment, difference information based on the last reflection face, which is acquired based on the BD signal 118 (image formation BD signal 116) at the time of image formation, is referred to as "third difference information". A change pattern based on the third difference information is referred to as "third change pattern". Difference information based on the second last reflection face, which is acquired based on the BD signal 118 (image formation BD signal 116) at the time of image formation, is referred to as "fourth difference information". A change pattern based on the fourth difference information is referred to as "fourth change pattern".

Referring to FIG. 7A, change patterns of the first difference information between adjacent faces being "long"→"short" are "Tc'→Td" and "Ta'→Tb". Of the BD cycles corresponding to those change patterns, the BD cycle for which the change pattern of the second difference information is "long" is the BD cycle Td'. Accordingly, the image controller 101 can determine that the BD cycle T3' is the BD cycle Td'. The image controller 101 identifies the reflection face d corresponding to the determined BD cycle Td'.

FIG. 7C is an illustration of an example of another BD signal 118 (image formation BD signal 116) at the time of image formation. In this case, when the image controller 101 measures the BD cycle T2', the image controller 101 compares the BD cycle T2' with the last BD cycle T1' to acquire the following difference information: "T2' is longer than T1'". When the image controller 101 measures the BD cycle T3', the image controller 101 compares the BD cycle T3' with the last BD cycle T2' to acquire the following difference information: "T3' is shorter than T2". Further, when the image controller 101 measures the BD cycle T3', the image controller 101 acquires the following difference information: "T3' is shorter than T1" through comparison with the second last BD cycle T1'.

The first change patterns being "long"→"short" are "Tc'→Td" and "Ta'→Tb'". Of the BD cycles corresponding to those change patterns, the BD cycle for which the change pattern of the second difference information is "short" is the BD cycle Tb'. Accordingly, the image controller 101 can determine that the BD cycle T3' is the BD cycle Tb'. The image controller 101 identifies the reflection face b corresponding to the determined BD cycle Tb'.

When the image controller 101 has successfully identified one reflection face, the image controller 101 can sequentially identify the subsequent reflection faces based on the image formation BD signal 116. This is because the reflection face is switched in order due to the revolution of the polygon mirror 401, and the image controller 101 acquires the image formation BD signal 116 every time the reflection face is switched.

Figure 8:
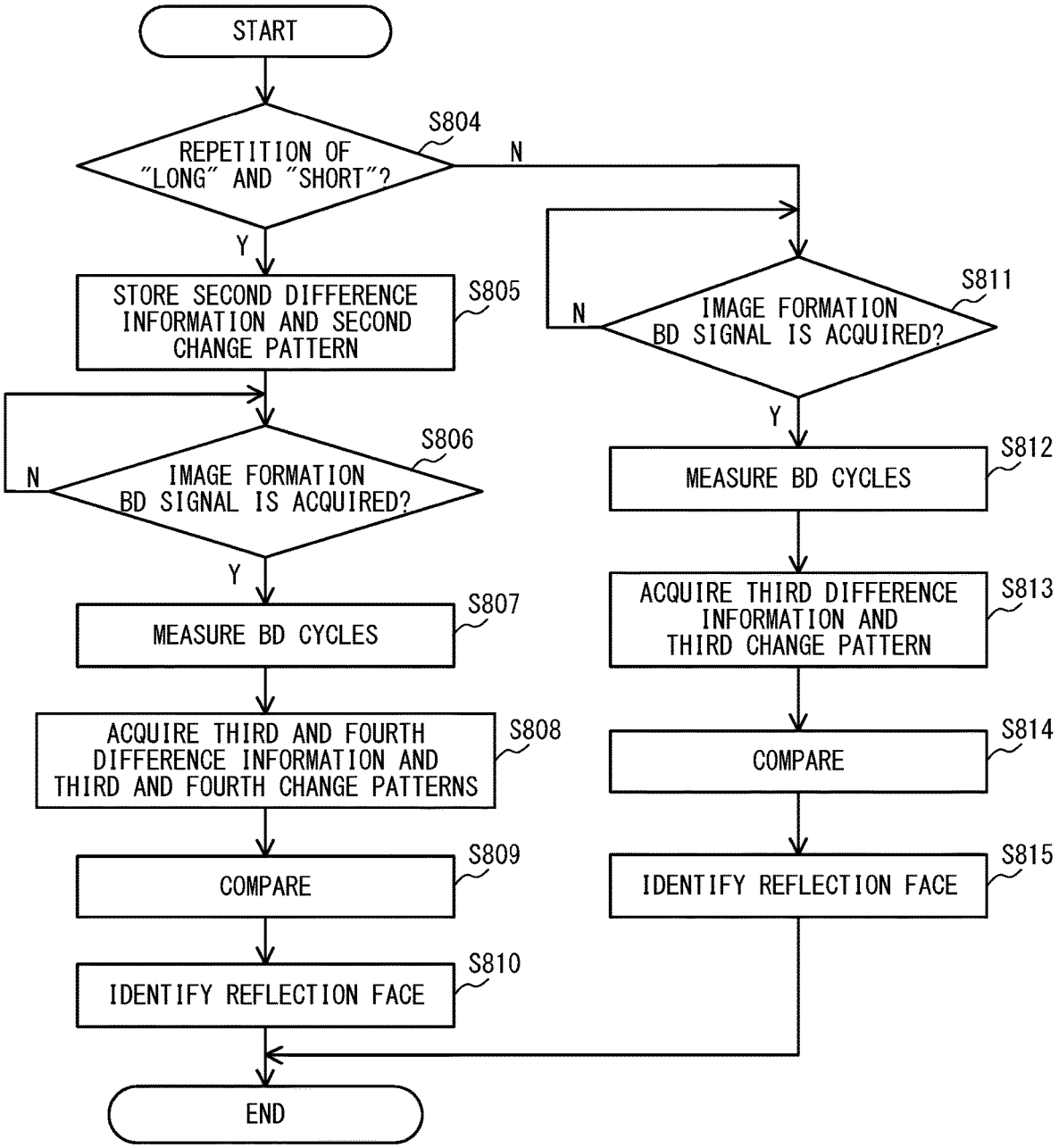
FIG. 8 is a flow chart for illustrating processing of identifying a reflection face.

FIG. 8 is a flow chart for illustrating processing of identifying a reflection face. In this case, an example of processing based on the BD signal 118 (image formation BD signal 116) illustrated in FIG. 7A, FIG. 7B, and FIG. 7C is described.

The image controller 101 determines whether or not the first change pattern is a repetition of "long" and "short" (Step S804). When the first change pattern is a repetition of "long" and "short" (Step S804: Y), the image controller 101 acquires second difference information and a second change pattern based on each of the BD cycles Ta', Tb', Tc', and Td', and stores the second difference information and the second change pattern in the memory (Step S805).

When image formation processing is started during the operation of the image forming apparatus 100, the image controller 101 acquires the image formation BD signal 116 from the engine controller 102 (Step S806: Y). The image controller 101 acquires three cycles of the image formation BD signals 116 to measure the BD cycles T1', T2', and T3' (Step S807). The image controller 101 acquires, based on the measured three BD cycles T1', T2', and T3', the third difference information and the third change pattern indicating a difference from the BD cycle of the last face, and acquires the fourth difference information and the fourth change pattern indicating a difference from the BD cycle of the second last face (Step S808). The image controller 101 compares the first difference information and the second difference information and the first and second change patterns stored in advance in the memory with the third difference information, the fourth difference information, and the third and fourth change patterns acquired in the processing of Step S808 (Step S809). The image controller 101 identifies a reflection face based on a result of the comparison (Step S810).

When the first change pattern is not a repetition of "long" and "short" (Step S804: N), the image controller 101 acquires the image formation BD signal from the engine controller 102 when image forming processing is started during the operation of the image forming apparatus 100 (Step S811: Y). The image controller 101 acquires three cycles of the image formation BD signals, and measures the BD cycles T1', T2', and T3' based on the respective image formation BD signals (Step S812). The image controller 101 acquires, based on the measured three BD cycles T1', T2', and T3', the third difference information and the third change pattern indicating a difference from the BD cycle of the last face (Step S813). The image controller 101 compares the first difference information and the first change pattern stored in advance in the memory with the third difference information and the third change pattern acquired in the processing of Step S813 (Step S814). The image controller 101 identifies a reflection face based on a result of the comparison (Step S815).

Through such comparison of pieces of difference information on the BD cycles, a reflection face of the polygon mirror 401 can be quickly identified. Thus, a period of time required for identifying a reflection face is shortened. The period of time required for identifying a reflection face is shortened, to thereby shorten a period of time required for printing.

In the above description, information of "long" or "short" is used as the change pattern of the difference information, and the processing of identifying a reflection face is performed based on this information. Through such processing, for example, as compared with a case in which processing of identifying a reflection face is performed by accurately measuring BD cycles and numerically comparing the BD cycles, processing of identifying a reflection face is simplified, and hence the processing of identifying a reflection face can be quickly performed.

As described above, when it is difficult to identify a reflection face through use of the first difference information indicating the difference from the BD cycle based on the last reflection face, a reflection face is identified through use of the second difference information indicating the difference from the BD cycle based on the second last reflection face. As a result, it is possible to more accurately identify a reflection face. As required, a reflection face may be identified through use of difference information indicating a difference from the BD cycle based on the third or more last reflection face.

In the first and second embodiments, the difference information may be measured through use of the BD cycle of a reflection face upstream in the rotation direction R, or may be measured through use of the BD cycle of a reflection face downstream in the rotation direction R. The change pattern of the difference information may be expressed by, instead of being expressed by "long" or "short", a positive number (indicated by a plus sign "+") or a negative number (indicated by a minus sign "−"). The number of reflection faces of the polygon mirror 401 is not limited to four. Even with a polygon mirror having three reflection faces or five or more reflection faces, for example, a reflection face can be identified quickly through the above-mentioned processing.

Through formation of an image through use of the polygon mirror 401 having the plurality of reflection faces having different lengths for reflecting a laser beam as described above, a reflection face can be identified easily and quickly. The image forming apparatus 100 uses the BD signal to measure the BD cycle of each reflection face, and can easily identify a reflection face based on a change pattern of the difference between the BD cycles. The image forming apparatus 100 forms an image through use of image data that has been corrected based on a correction value corresponding to the identified reflection face, to thereby be able to form a high-quality image on a recording material in a short period of time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-169160, filed Sep. 10, 2018 which is hereby incorporated by reference herein in its entirety.

What is claimed is:

1. An information processing apparatus, which is connectable to an image forming apparatus including an image forming unit, the image forming unit comprising:

a photosensitive member;

a receiver configured to receive image data;

a light source configured to output light based on the image data received by the receiver;

a rotary polygon mirror, which has a plurality of reflection faces, and is configured to rotate to deflect the light output from the light source by the plurality of reflection faces, to thereby scan the photosensitive member;

a light receiver configured to receive the light deflected by the rotary polygon mirror; and a first output unit configured to output, based on a result of receiving the light by the light receiver, a pulse signal containing a pulse train including a signal of a first level and a signal of a second level, the information processing apparatus comprising:

a storage configured to store first information indicating whether or not a length of a scanning cycle corresponding to a first face among the plurality of reflection faces is longer than a length of a scanning cycle corresponding to a second face different from the first face, the first face being a reflection face adjacent to the second face in a rotation direction in which the rotary polygon mirror rotates;

an identifier configured to identify a reflection face to be used for scanning of the photosensitive member from among the plurality of reflection faces based on the first information stored in the storage and on whether or not a first time interval is longer than a second time interval, wherein the first time interval is a time interval between a first pulse included in the pulse train and a second pulse subsequent to the first pulse, and the second time interval is a time interval between the second pulse and a third pulse subsequent to the second pulse;

a corrector configured to correct the image data corresponding to the reflection face identified by the identifier based on a correction data corresponding to the reflection face identified by the identifier; and a second output unit configured to output the image data corrected by the corrector to the image forming unit in response to a pulse being output from the first output unit.

2. The information processing apparatus according to claim 1, wherein the identifier is configured to update face information indicating the reflection face every time the pulse is output from the first output unit, after the reflection face to be used for scanning of the photosensitive member is identified from among the plurality of reflection faces, and wherein the corrector is configured to correct the image data corresponding to the reflection face identified by the identifier based on the correction data corresponding to the face information.

3. The information processing apparatus according to claim 1, wherein the image forming unit further comprises a circuit board on which the first output unit is mounted and a circuit board on which the second output unit is mounted, which are different from each other.

4. An information processing apparatus, which is connectable to an image forming apparatus including an image forming unit, the image forming unit comprising:

a photosensitive member;

a receiver configured to receive image data;

a light source configured to output light based on the image data received by the receiver;

a rotary polygon mirror, which has a plurality of reflection faces, and is configured to rotate to deflect the light output from the light source by the plurality of reflection faces, to thereby scan the photosensitive member;

a light receiver configured to receive the light deflected by the rotary polygon mirror; and a first output unit configured to output, based on a result of receiving the light by the light receiver, a pulse signal containing a pulse train including a signal of a first level and a signal of a second level, the information processing apparatus comprising:

a storage configured to store first information indicating whether or not a length of a scanning cycle corresponding to a first face among the plurality of reflection faces is longer than a length of a scanning cycle corresponding to a second face different from the first face;

an identifier configured to identify a reflection face to be used for scanning of the photosensitive member from among the plurality of reflection faces based on the first information stored in the storage and on whether or not a first time interval is longer than a second time interval, wherein the first time interval is a time interval between a first pulse included in the pulse train and a second pulse subsequent to the first pulse, and the second time interval is a time interval between a third pulse included in the pulse train and a fourth pulse subsequent to the third pulse;

a corrector configured to correct the image data corresponding to the reflection face identified by the identifier based on a correction data corresponding to the reflection face identified by the identifier; and a second output unit configured to output the image data corrected by the corrector to the image forming unit in response to a pulse being output from the first output unit.

5. The information processing apparatus according to claim 4, wherein the identifier is configured to update face information indicating the reflection face every time the pulse is output from the first output unit, after the reflection face to be used for scanning of the photosensitive member is identified from among the plurality of reflection faces, and wherein the corrector is configured to correct the image data corresponding to the reflection face identified by the identifier based on the correction data corresponding to the face information.

6. The information processing apparatus according to claim 4, wherein the information processing apparatus further comprises a circuit board on which the first output unit is mounted and a circuit board on which the second output unit is mounted, which are different from each other.

7. An image forming apparatus comprising:

a photosensitive member;

a receiver configured to receive image data;

a light source configured to output light based on the image data received by the receiver;

a rotary polygon mirror, which has a plurality of reflection faces, and is configured to rotate to deflect the light output from the light source by the plurality of reflection faces, to thereby scan the photosensitive member;

a light receiver configured to receive the light deflected by the rotary polygon mirror;

a first output unit configured to output, based on a result of receiving the light by the light receiver, a pulse signal containing a pulse train including a signal of a first level and a signal of a second level;

a storage configured to store first information indicating whether or not a length of a scanning cycle corresponding to a first face among the plurality of reflection faces is longer than a length of a scanning cycle corresponding to a second face different from the first face, the first face being a reflection face adjacent to the second face in a rotation direction in which the rotary polygon mirror rotates;

an identifier configured to identify a reflection face to be used for scanning of the photosensitive member from among the plurality of reflection faces based on the first information stored in the storage and on whether or not a first time interval is longer than a second time interval, wherein the first time interval is a time interval between a first pulse included in the pulse train and a second pulse subsequent to the first pulse, and the second time interval is a time interval between the second pulse and a third pulse subsequent to the second pulse;

a corrector configured to correct the image data corresponding to the reflection face identified by the identifier based on a correction data corresponding to the reflection face identified by the identifier; and a second output unit configured to output the image data corrected by the corrector in response to a pulse being output from the first output unit.

8. An image forming apparatus comprising:

a photosensitive member;

a receiver configured to receive image data;

a light source configured to output light based on the image data received by the receiver;

a rotary polygon mirror, which has a plurality of reflection faces, and is configured to rotate to deflect the light output from the light source by the plurality of reflection faces, to thereby scan the photosensitive member;

a light receiver configured to receive the light deflected by the rotary polygon mirror;

a first output unit configured to output, based on a result of receiving the light by the light receiver, a pulse signal containing a pulse train including a signal of a first level and a signal of a second level;

a storage configured to store first information indicating whether or not a length of a scanning cycle corresponding to a first face among the plurality of reflection faces is longer than a length of a scanning cycle corresponding to a second face different from the first face;

an identifier configured to identify a reflection face to be used for scanning of the photosensitive member from among the plurality of reflection faces based on the first information stored in the storage and on whether or not a first time interval is longer than a second time interval, wherein the first time interval is a time interval between a first pulse included in the pulse train and a second pulse subsequent to the first pulse, and the second time interval is a time interval between a third pulse included in the pulse train and a fourth pulse subsequent to the third pulse;

a corrector configured to correct the image data corresponding to the reflection face identified by the identifier based on a correction data corresponding to the reflection face identified by the identifier; and a second output unit configured to output the image data corrected by the corrector in response to a pulse being output from the first output unit.

* * * * *